US011815315B2

(12) United States Patent
Liu et al.

(10) Patent No.: US 11,815,315 B2
(45) Date of Patent: Nov. 14, 2023

(54) FLEXIBLE HEAT DISSIPATION DEVICE

(71) Applicant: ASIA VITAL COMPONENTS (CHINA) CO., LTD., Shenzhen (CN)

(72) Inventors: Han-Min Liu, Shenzhen (CN); Xiao-Xiang Zhou, Shenzhen (CN); Shi-Lei Wei, Shenzhen (CN)

(73) Assignee: Asia Vital Components (China) Co., Ltd., Shenzhen (CN)

( * ) Notice: Subject to any disclaimer, the term of this patent is extended or adjusted under 35 U.S.C. 154(b) by 0 days.

(21) Appl. No.: 17/178,266

(22) Filed: Feb. 18, 2021

(65) Prior Publication Data

US 2022/0260321 A1 Aug. 18, 2022

(51) Int. Cl.
*F28D 15/02* (2006.01)
*F28D 15/04* (2006.01)

(52) U.S. Cl.
CPC ..... *F28D 15/0241* (2013.01); *F28D 15/043* (2013.01); *F28D 15/046* (2013.01); *F28D 2015/0216* (2013.01)

(58) Field of Classification Search
CPC .. F28D 15/0241; F28D 15/043; F28D 15/046; F28D 2015/0216; H01L 23/427
See application file for complete search history.

(56) References Cited

U.S. PATENT DOCUMENTS 6,105,662 A * 8/2000 Suzuki ..... F28D 15/0266 165/185
6,152,213 A * 11/2000 Suzuki ..... F28D 15/0266 174/15.2
8,007,417 B2 * 8/2011 Heller ..... A63B 22/18 482/142
10,184,729 B2 * 1/2019 Inagaki ..... F28D 15/0241
2004/0163798 A1 * 8/2004 Ghosh ..... F28F 1/40 165/104.21
2005/0180109 A1 * 8/2005 Miyazaki ..... G06F 1/203 361/700

(Continued)

FOREIGN PATENT DOCUMENTS

TW M556324 U 3/2018
TW I660151 B 5/2019
TW M610096 U 4/2021

OTHER PUBLICATIONS

Search Report dated Nov. 28, 2022 issued by Taiwan Intellectual Property Office for counterpart application No. 110100621.

*Primary Examiner* — Gordon A Jones
(74) *Attorney, Agent, or Firm* — Brad J. Thorson; DeWitt LLP

(57) ABSTRACT

A flexible heat dissipation device includes an evaporator, a vapor tube, a liquid tube and a condenser. The evaporator has at least one vapor chamber. A capillary structure and a working fluid are received in the vapor chamber. Two ends of the vapor tube is respectively in communication with one end of the evaporator and the condenser. Two ends of the liquid tube are respectively in communication with the evaporator and the condenser, whereby the evaporator, the vapor tube, the condenser and the liquid tube form a loop for the working fluid to flow through. At least one bellows section is disposed on one or both of the vapor tube and the liquid tube. The bellows section has multiple waved stripes. More than one of the heights, widths and pitches of the multiple waved stripes are equal to or unequal to each other.

5 Claims, 6 Drawing Sheets

(56) References Cited

U.S. PATENT DOCUMENTS

| | | | | |
|---|---|---|---|---|
| 2005/0189727 | A1* | 9/2005 | Smith | F25B 9/145 277/634 |
| 2006/0086482 | A1* | 4/2006 | Thayer | F28D 15/0241 165/104.26 |
| 2007/0227703 | A1 | 10/2007 | Bhatti et al. | |
| 2008/0078530 | A1* | 4/2008 | Chang | F28D 15/043 165/104.21 |
| 2018/0031329 | A1* | 2/2018 | Wang | G06F 1/203 |
| 2019/0186840 | A1 | 6/2019 | Chiang | |
| 2020/0370838 | A1 | 11/2020 | North et al. | |
| 2021/0301505 | A1* | 9/2021 | Saavedra | F28F 1/126 |

* cited by examiner

FLEXIBLE HEAT DISSIPATION DEVICE

BACKGROUND OF THE INVENTION

1. Field of the Invention

The present invention relates generally to a flexible heat dissipation device, and more particularly to a flexible heat dissipation device, which can be bent to absorb the bridging force of the tubes.

2. Description of the Related Art

Along with the continuous increase of the power of the electronic components such as central processing unit, heat dissipation problem has been more and more valued. The loop heat pipe has high heat transfer performance so that the loop heat pipe is widely applied in heat dissipation field.

In general, a conventional loop heat pipe includes an evaporation section, a condensation section and a vapor tube and a liquid tube disposed between the evaporation section and the condensation section. The vapor tube and the liquid tube connect the evaporation section and the condensation section to form a loop, in which pure water is filled. The evaporation section is connected with a heat generation component (such as a central processing unit or a graphics processing unit). When the evaporation section of the loop heat pipe absorbs the heat of the heat generation component, the pure water in the evaporation section is heated and evaporated into vapor. The vapor passes through the vapor tube and flows to the condensation section of the loop heat pipe. The heat is radiated from the condensation section and the vapor is condensed into liquid. After condensed, the liquid working medium passes through the liquid tube and flows back to the evaporation section to complete a circulation. Accordingly, the pure water is repeatedly evaporated and condensed to continuously absorb heat and dissipate the heat so as to achieve the heat exchange effect. However, multiple electronic components (such as capacitors, transistors, resistors and inductors) are arranged around the heat generation component on the motherboard in the electronic device (such as a server or a communication chassis). The heat generation component and the other electronic components around the heat generation component have different heights so that the vapor tube and the liquid tube of the loop heat pipe must be previously designed to bypass and avoid the multiple electronic components on the motherboard. In this case, there is room for arranging the vapor tube and the liquid tube. As a result, the loop heat pipe cannot be applied to various specifications or model Nos. of motherboards. In addition, it is necessary for the vapor tube and the liquid tube to bypass and avoid the multiple electronic components so that the cost is increased. Moreover, the evaporator is attached to the outer surface of the heat generation component, while the condensation section is securely assembled on the outer surface of a fixed platform. The evaporator and the condensation section are not positioned on the same level. Furthermore, the evaporation section and the condensation section are connected by means of inflexible (unbendable) vapor tube and liquid tube, which are made of inflexible metal material (via straight copper tube welding). Also, these tubes have considerable length. Therefore, it is hard to control the levels of the evaporation section and the condensation section in assembling process. In case the evaporation section and the condensation section are forcedly assembled in two different positions, (that is, the heat generation component and the fixed platform) with different levels, the bridging force of these tubes will pull the evaporation section and the condensation section. In this case, the evaporation section can hardly snugly attach to and contact the surface of the heat generation component. Also, the condensation section can hardly snugly attach to and contact the surface of the fixed platform.

SUMMARY OF THE INVENTION

It is therefore a primary object of the present invention to provide a flexible heat dissipation device, which can be bent to absorb the bridging force of the tubes.

It is a further object of the present invention to provide the above flexible heat dissipation device, in which the evaporator can snugly attach to and contact the surface of the heat generation component and the condenser can snugly attach to and contact the surface of a component in an electronic device.

It is still a further object of the present invention to provide the above flexible heat dissipation device, in which at least one bellows section is disposed on one or both of the vapor tube and the liquid tube. The bellows section can be freely bent and deformed by any angle or in any direction, whereby the heights of the vapor tube and the liquid tube can be adjusted so that the vapor tube and the liquid tube can be assembled and aligned with the corresponding evaporator, condenser and heat generation component.

To achieve the above and other objects, the flexible heat dissipation device of the present invention includes an evaporator, a vapor tube, a liquid tube and a condenser. The evaporator has at least one vapor chamber, a liquid inlet and a vapor outlet. A capillary structure and a working fluid are received in the vapor chamber. The liquid inlet and the vapor outlet are in communication with the vapor chamber. One end of the vapor tube is in communication with the vapor outlet. The other end of the vapor tube is in communication with the condenser. Two ends of the liquid tube are respectively in communication with the evaporator and the condenser, whereby the evaporator, the vapor tube, the condenser and the liquid tube form a loop for the working fluid to flow through. At least one bellows section is disposed on one or both of the vapor tube and the liquid tube. The bellows section has multiple waved stripes. More than one of the heights, widths and pitches of the multiple waved stripes are equal to or unequal to each other.

Still to achieve the above and other objects, the flexible heat dissipation device of the present invention includes an evaporator, at least one bellows section and a vapor/liquid loop tube. The evaporator has a vapor chamber, a liquid inlet and a vapor outlet. A capillary structure and a working fluid are received in the vapor chamber. The liquid inlet and the vapor outlet are in communication with the vapor chamber. The vapor/liquid loop tube has a vapor section and a liquid section. One end of the vapor section and one end of the liquid section are respectively in communication with the vapor outlet and the liquid inlet. The other end of the vapor section outward integrally extends to connect with the other end of the liquid section and a condensation section is formed therebetween. A condensation component is disposed on outer side of the condensation section. At least one bellows section is disposed on one or both of the vapor section and the liquid section. The bellows section has multiple waved stripes. More than one of the heights, widths and pitches of the multiple waved stripes are equal to or unequal to each other.

A tube body capillary structure is disposed in the liquid tube. The tube body capillary structure is disposed on the inner surface of the liquid tube.

According to the design of the above embodiments of the present invention, the flexible heat dissipation device of the present invention can be flexed (bent) to absorb the bridging force of the tubes. Moreover, the flexible heat dissipation device of the present invention is adapted and applicable to different electronic components on the circuit board in various electronic devices (such as a server, a computer or a communication chassis) with height differences. The evaporator can effectively snugly tightly attach to the heat generation component.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1A:
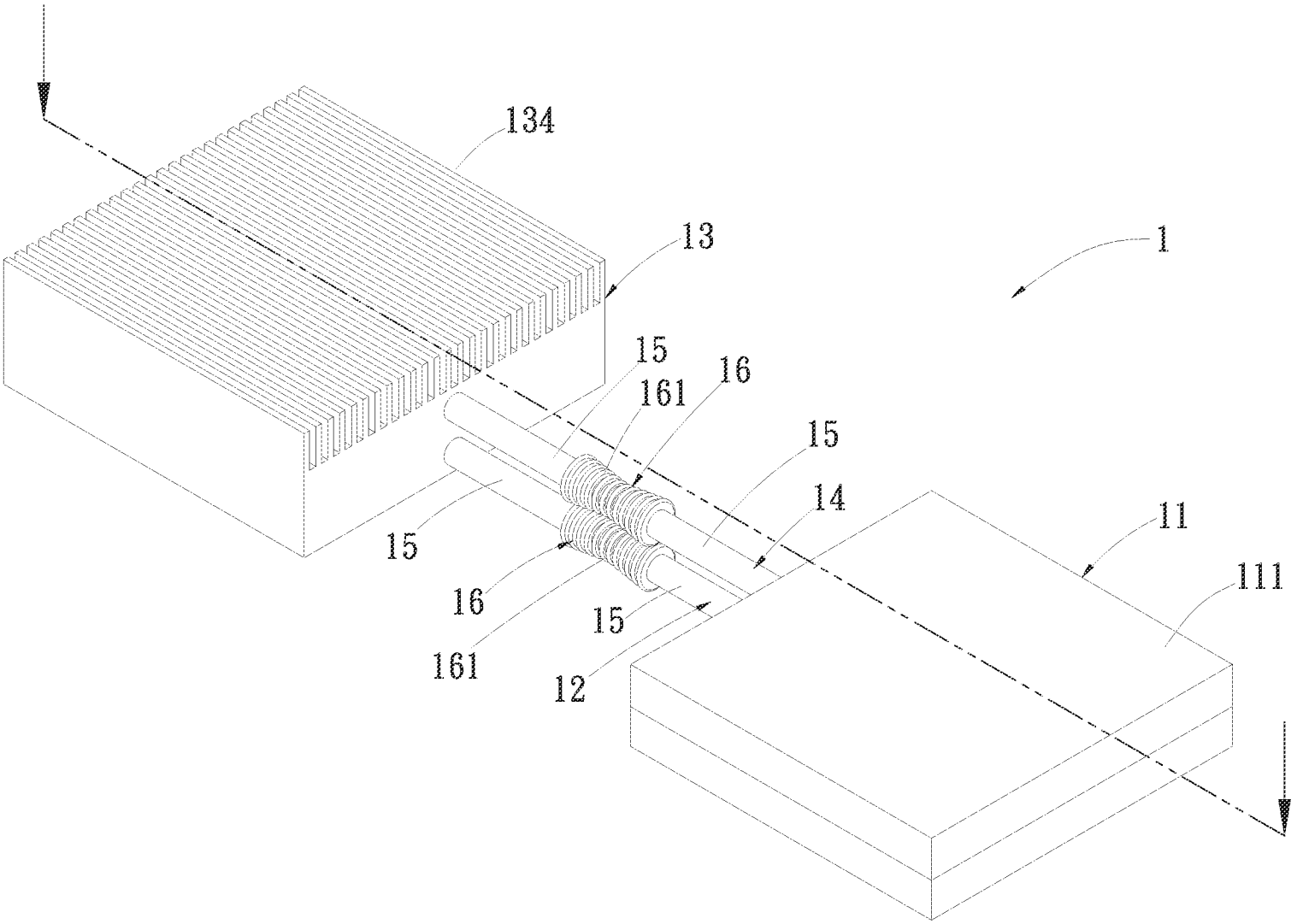
FIG. 1A is a perspective assembled view of a first embodiment of the flexible heat dissipation device of the present invention.
Figure 1B:
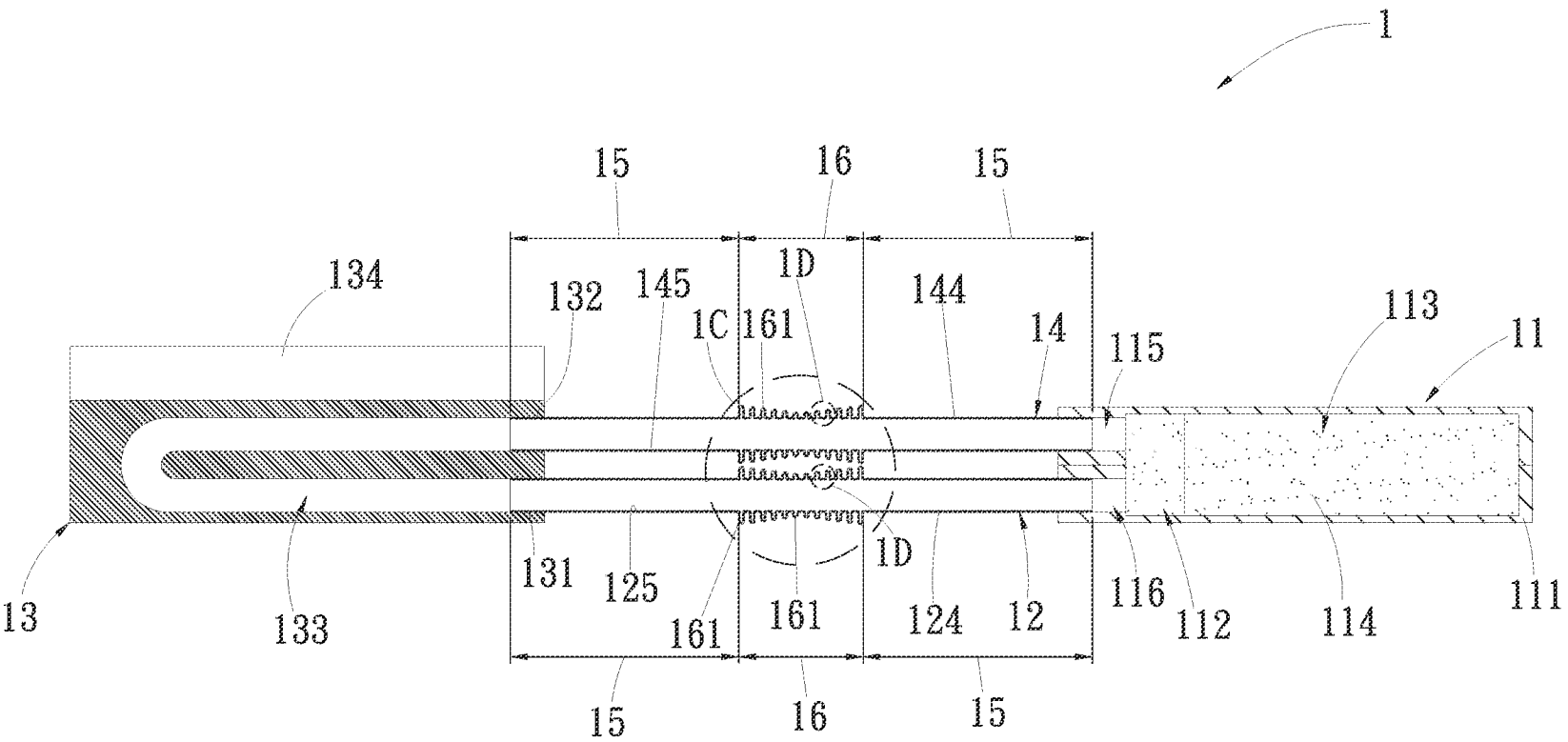
FIG. 1B is a sectional view of the first embodiment of the flexible heat dissipation device of the present invention.

Please refer to FIGS. 1A to 3. The flexible heat dissipation device 1 of the present invention can be a loop heat pipe (LHP) or a two-phase loop thermosyphon (LTS). The flexible heat dissipation device 1 includes an evaporator 11, a vapor tube 12, a condenser 13, at least one bellows section 16 and a liquid tube 14. The evaporator 11 is tightly attached to a heat generation component 42 (such as a central processing unit or a graphics processing unit) on a circuit board 4 (such as a motherboard) in an electronic device (such as a server, a computer or a communication chassis). The circuit board 4 further includes multiple electronic components 41 with different heights, (such as capacitors, resistors, inductors or transistors). The electronic components 41 are arranged around the heat generation component 42. The evaporator 11 has a case 111, at least one vapor chamber 113, a liquid inlet 115 and a vapor outlet 116. The case 111 is made of metal material (such as stainless steel, titanium, aluminum, copper or other metal). The inner wall of the case 111 defines the vapor chamber 113. At least one capillary structure 114 and a working fluid are received in the vapor chamber 113. The capillary structure 114 is a porous structure selected from a group consisting of sintered powder, micro-channel, woven mesh, fiber, braid body and any combination thereof as a complex capillary structure. In this embodiment, the capillary structure 114 is, but not limited to, a woven mesh for illustration. The working fluid is such as pure water, methyl alcohol, distilled water or a mixture thereof. The working fluid is converted between vapor phase and liquid phase to achieve heat transfer.

In this embodiment, the liquid inlet 115 and vapor outlet 116 are, but not limited to, respectively formed on the same side of the case 111 and the liquid inlet 115 is positioned above the vapor outlet 116. In practice, the liquid inlet 115 and the vapor outlet 116 can be alternatively respectively disposed on the opposite sides of the case 111. The liquid inlet 115 and vapor outlet 116 are in communication with the vapor chamber 113. A vapor passage 112 is defined between the vapor chamber 113 in the case 111 and the corresponding vapor outlet 116. The vapor passage 112 is in communication with the vapor outlet 116 and one end of the vapor tube 12. Accordingly, after evaporated, the vapor working fluid passes through the vapor passage 112 and the vapor outlet 116 to enter the vapor tube 12.

The vapor tube 12 and the liquid tube 14 are made of metal material (such as stainless steel, titanium, aluminum, copper or other metal). One end of the vapor tube 12 is connected with the vapor outlet 116 of the case 111 so that the end of the vapor tube 12 is in communication with the vapor outlet 116 and the vapor chamber 113. The other end of the vapor tube 12 is in communication with the condenser 13. The condenser 13 is connected with a component in the electronic device, (such as a fan support or heat dissipation fixed platform). In this embodiment, the condenser 13, (which can be a radiator or water-cooling radiator), has a vapor inlet 131, a liquid outlet 132, a vapor/liquid mixture passage 133 and multiple radiating fins 134. The vapor/liquid mixture passage 133 extends upward from the vapor inlet 131 to the liquid outlet 132 to connect and communicate with the liquid outlet 132. The multiple radiating fins 134 are arranged on the outer surface of the top section of the condenser 13 at intervals. The other end of the vapor tube 12 connects and communicates with the vapor inlet 131. One end and the other end of the liquid tube 14 respectively connect and communicate with the liquid outlet 132 and the liquid inlet 115. Two ends of the liquid tube 14 respectively communicate with the evaporator 11 and the condenser 13, whereby the evaporator 11, the vapor tube 12, the condenser 13 and the liquid tube 14 form a loop for the working fluid to flow through. When the evaporator 11 absorbs the heat of the heat generation component 42, the working fluid in the evaporator 11 is heated and evaporated to produce vapor working fluid. By means of pressure difference, the vapor working fluid in the vapor passage 112 is driven to pass through the vapor outlet 116 and the vapor tube 12 and flow through the vapor inlet 131 into the vapor/liquid mixture passage 133 of the condenser 13. The condenser 13 and the multiple radiating fins 134 absorb the heat of the vapor working fluid, whereby the vapor working fluid is condensed and converted into liquid working fluid. The liquid working fluid passes through the liquid outlet 132 and the polished inner surface 145 of the liquid tube 14 to flow through the liquid inlet 115 back into the vapor chamber 113 of the evaporator 11 for next circulation. The vapor tube 12 and the liquid tube 14 are respectively connected with the evaporator 11 and the condenser 13 by means of welding, insertion or adhesion.

At least one bellows section 16 is disposed on one or both of the vapor tube 12 and the liquid tube 14. In this embodiment, the bellows sections 16 are disposed on both of the vapor tube 12 and the liquid tube 14. Two ends of the bellows section 16 are respectively connected with a straight section 15. The bellows section 16 has multiple waved stripes 161 arranged at intervals or continuously. The multiple waved stripes 161 are multiple recessed/raised structures or wave peaks and wave troughs, which are alternately arranged. The bellows section 16 has excellent extensible/contractible elasticity and can be bent and folded onto itself (into a U-shaped configuration) to achieve shock absorption effect. In a preferred embodiment, the bellows section 16 is disposed on the vapor tube 12 or the liquid tube 14.

In this embodiment, at least one of the vapor tube 12 and the liquid tube 14 has a polished inner surface or a tube body capillary structure is disposed on the inner surface of the tube body of the vapor tube 12 or the liquid tube 14.

In addition, more than one of the heights X, widths Y and pitches 181 of the multiple waved stripes 161 are equal to or unequal to each other. The pitches 181 of the multiple waved stripes 161 can be equal to or unequal to each other. Each waved stripe 161 has a waved stripe top end 1611 and a waved stripe bottom end 1612. The waved stripe bottom end 1612 is positioned in adjacency to an outer surface 124, 144 of each of the vapor tube 12 and the liquid tube 14. (That is, the waved stripe bottom end 1612 is positioned on the same level as the outer surface 124, 144 or positioned on a level higher/lower than the outer surface 124, 144). The waved stripe top end 1611 is raised from the outer surface 124, 144 of each of the vapor tube 12 and the liquid tube 14. The height X of the waved stripe 161 is defined between the waved stripe top end 1611 and the waved stripe bottom end 1612.

Please refer to the respective drawings. The heights X of the multiple waved stripes 161 are equal to or unequal to each other. For example, the heights X of the multiple waved stripes 161 are gradually decreased from two sides of the bellows section 161 to the middle thereof. That is, the heights X of the waved stripes 161 at the middle of the bellows section 16 are lower and the heights X of the waved stripes 161 on two sides of the bellows section 16 are gradually increased. The heights X of the waved stripes 161 at the middle of the bellows section 16 are lower than the heights X of the waved stripes 161 on two sides of the bellows section 16 so that when the bellows section 16 is bent, the waved stripes 161 at the middle of the bellows section 16 will not interfere with the waved stripes 161 on two sides of the bellows section 16. Therefore, the bellows section 16 can be freely flexed (bent) by any angle or in any direction or folded onto itself. This improves the problem that the bending angle of the bellows section is limited. Moreover, the flexible heat dissipation device of the present invention is adapted and applicable to various circuit boards 4 and the electronic components 41 on the circuit boards 4 with height differences.

Figure 1C:
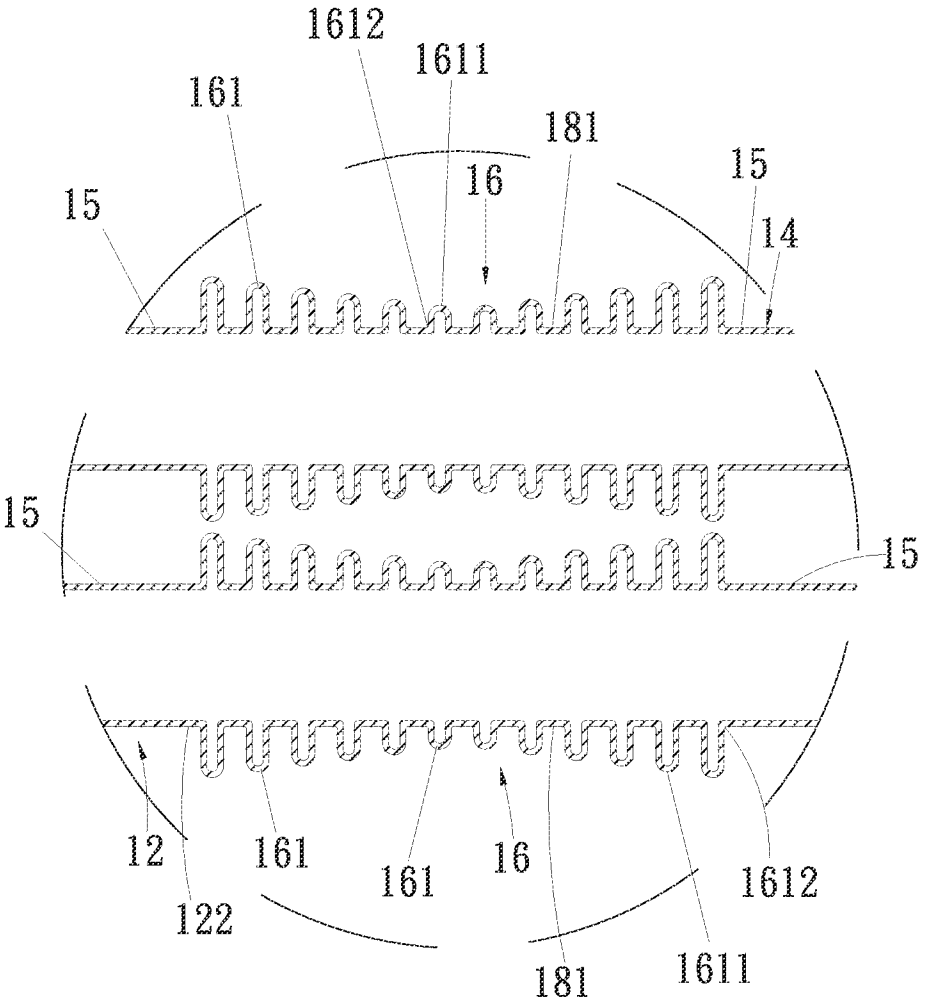
FIG. 1C is an enlarged view of circled area 1C of FIG. 1B, showing the bellows sections of the vapor tube and the liquid tube of the flexible heat dissipation device of the present invention.
Figure 1D:
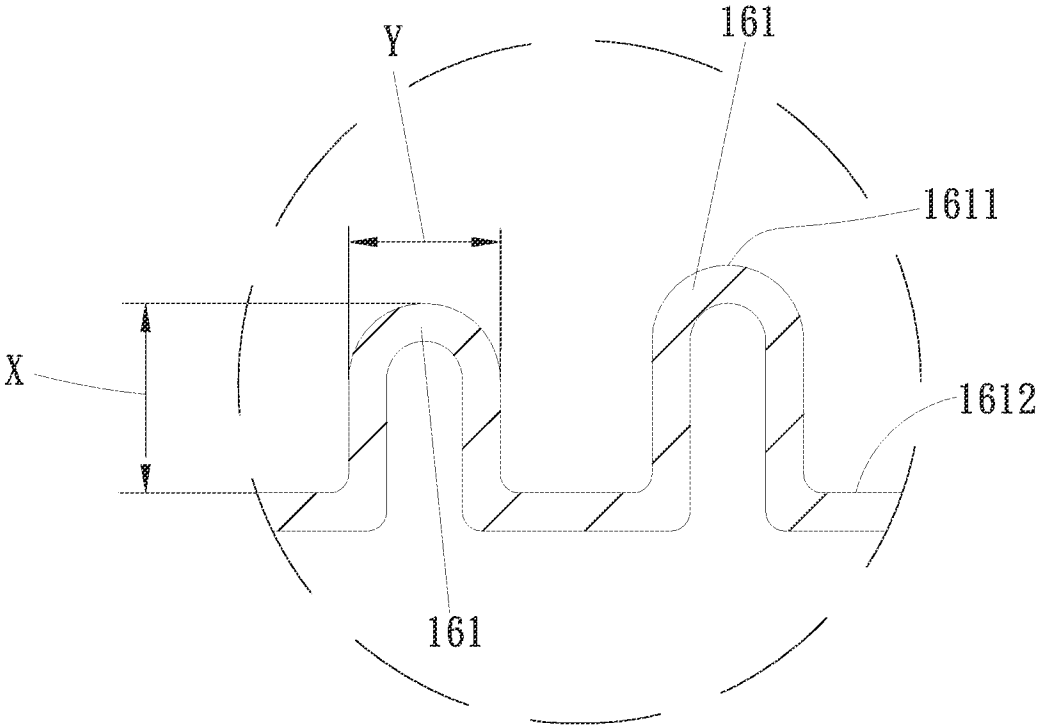
FIG. 1D is an enlarged view of circled area 1D of FIG. 1B, showing the waved stripes of the bellows section.
Figure 2:
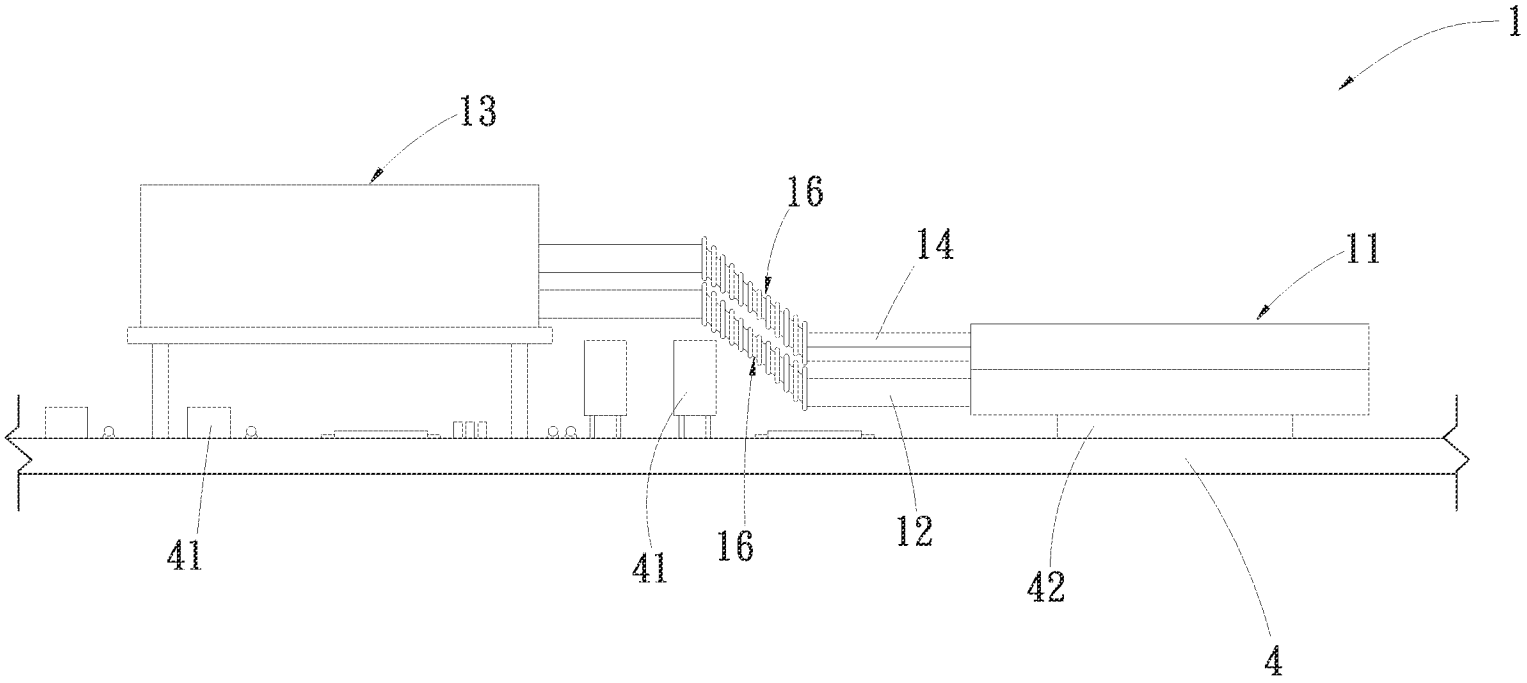
FIG. 2 is a side view showing that the first embodiment of the flexible heat dissipation device of the present invention is applied to an electronic device.
Figure 3:
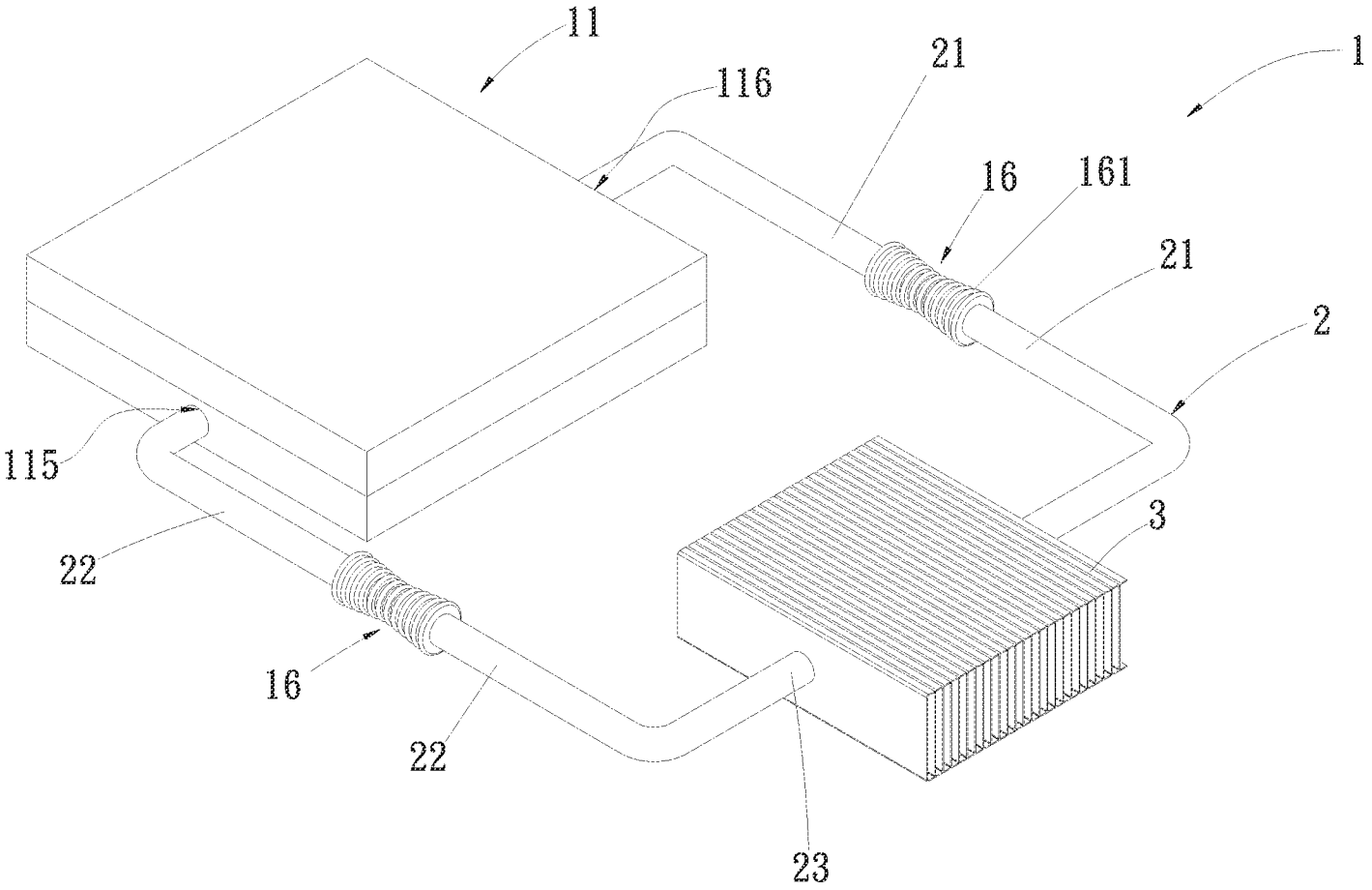
FIG. 3 is a perspective assembled view of a second embodiment of the flexible heat dissipation device of the present invention.

Please now refer to FIG. 3 as well as FIGS. 1C and 1D. In a modified embodiment, the liquid tube 14 and the vapor tube 12 of the above embodiment are modified into one single loop. Two ends of the loop communicate with the liquid inlet 115 and the vapor outlet 116 of the evaporator 11. For easy illustration, the loop is so-termed vapor/liquid loop tube 2 hereinafter. The vapor/liquid loop tube 2 has a vapor section 21 and a liquid section 22. One end of the vapor section 21 and one end of the liquid section 22 are respectively in communication with the vapor outlet 116 and the liquid inlet 115 and the vapor chamber 113. The other end of the vapor section 21 outward integrally extends to connect with the other end of the liquid section 22 and a condensation section 23 is formed therebetween. A condensation component 3 (such as multiple radiating fins) is disposed on outer side of the condensation section 23. At least one bellows section 16 is disposed on one or both of the vapor section 21 and the liquid section 22. In this embodiment, there are two bellows sections 16 respectively disposed on both of the vapor section 21 and the liquid section 22. Each bellows section 16 has multiple waved stripes 161 arranged at intervals (or continuously). The features of the bellows section 16, (that is, the heights X, widths Y and pitches 181 of the waved stripes 161 are equal to or unequal to each other), are identical to those of the aforesaid bellows section 16 and thus will not be redundantly described hereinafter.

It should be noted that the multiple waved stripes 161 of the bellows section 16 are annular waved stripes surrounding the tube bodies of the vapor tube 12 and the liquid tube 14 as closed loops. In a modified embodiment, the multiple waved stripes 161 are spiral waved stripes arranged around the tube bodies of the vapor tube 12 and the liquid tube 14 in a spiral form.

Please refer to the respective drawings. When the flexible heat dissipation device 1 is assembled on the electronic device, the evaporator 11 is attached to the heat generation component 42. Thereafter, by means of the bellows section 16 of one of the vapor tube 12 and the liquid tube 14, the flexible heat dissipation device 1 can be freely bent by any angle or in any direction, (such as upward, downward, leftward or rightward bent) to deform and adjust the position. The multiple waved stripes 161 provide excellent extensible/contractible elasticity, whereby the vapor tube 12 and the liquid tube 14 can be extended to elongate the length so as to bypass the higher electronic component 41 around the heat generation component 42. Also, the bellows section 16 can absorb the pull applied by the vapor tube 12 and the liquid tube 14 to the evaporator 11 and the condenser 13 due to the bridging force of these tubes.

The present invention has been described with the above embodiments thereof and it is understood that many changes and modifications in such as the form or layout pattern or practicing step of the above embodiments can be carried out without departing from the scope and the spirit of the invention that is intended to be limited only by the appended claims.

What is claimed is:

1. A flexible heat dissipation device comprising:

a condenser;

an evaporator having at least one vapor chamber, a liquid inlet and a vapor outlet, a capillary structure and a working fluid being received in the vapor chamber, the liquid inlet and the vapor outlet being in communication with the vapor chamber;

a vapor tube, one end of the vapor tube being in communication with the vapor outlet, the other end of the vapor tube being in communication with the condenser;

a liquid tube, two ends of the liquid tube being respectively in communication with the evaporator and the condenser, whereby the evaporator, the vapor tube, the condenser and the liquid tube form a loop for the working fluid to flow through; and at least one bellows section disposed on one or both of the vapor tube and the liquid tube, the bellows section having multiple waved stripes, one or more of heights, widths and pitches of at least one of the multiple waved stripes being unequal to a height, a width and a pitch of an adjacent one of the multiple waved stripes;

wherein the heights of the multiple waved stripes are gradually decreased from two sides of the bellows section to a middle of the bellows, so that when the bellows section is bent, the waved stripes at the middle of the bellows section will not interfere with the waved stripes on the two sides of the bellows section.

2. The flexible heat dissipation device as claimed in claim 1, wherein each waved stripe has a top end and a bottom end, the bottom end being positioned on an outer surface of each of the vapor tube and the liquid tube, the top end being raised from the outer surface of each of the vapor tube and the liquid tube.

3. The flexible heat dissipation device as claimed in claim 2, wherein the height of each waved stripe is defined between the top end and the bottom end.

4. The flexible heat dissipation device as claimed in claim 1, wherein the multiple waved stripes are annular waved stripes or spiral waved stripes.

5. The flexible heat dissipation device as claimed in claim 1, wherein the capillary structure is selected from a group consisting of sintered powder, micro-channel, woven mesh, fiber and any combination thereof as a complex capillary structure.

* * * * *